US006050350A

United States Patent [19]

Morris et al.

[11] Patent Number: 6,050,350

[45] Date of Patent: Apr. 18, 2000

[54] UNDERGROUND DIRECTIONAL DRILLING STEERING TOOL

[76] Inventors: Waldo Morris, R.R. 2, Marion, Iowa 82302; Bruce Heims, 101 E. Linn St. P.O. Box 185, Coggon, Iowa 52218

[21] Appl. No.: 08/854,370

[22] Filed: May 12, 1997

[51] Int. Cl.[7] ..... E21B 7/06

[52] U.S. Cl. ..... 175/45; 175/73

[58] Field of Search ..... 175/73, 76, 45

[56] References Cited

U.S. PATENT DOCUMENTS

| | | | |
|---|---|---|---|
| 3,363,704 | 1/1968 | Farris et al. | 175/76 |
| 3,746,106 | 7/1973 | McCullough et al. | 175/45 |
| 4,040,495 | 8/1977 | Kellner et al. | 175/73 |
| 4,076,084 | 2/1978 | Tighe | 175/73 |
| 4,220,214 | 9/1980 | Benoit | 175/61 |
| 4,407,374 | 10/1983 | Wallussek et al. | 175/24 |
| 4,732,223 | 3/1988 | Schoeffler et al. | 175/73 |
| 5,000,272 | 3/1991 | Wiebe et al. | 175/73 |
| 5,341,886 | 8/1994 | Patton | 175/73 |
| 5,449,046 | 9/1995 | Kinnan | 175/24 |
| 5,490,569 | 2/1996 | Brotherton et al. | 175/61 |
| 5,529,133 | 6/1996 | Eddison | 175/61 |
| 5,547,031 | 8/1996 | Warren et al. | 175/61 |

FOREIGN PATENT DOCUMENTS

| | | | |
|---|---|---|---|
| 2230288 | 10/1990 | United Kingdom | 175/76 |

OTHER PUBLICATIONS

No–Dig International, A First in France, Sep. 1996, by Ian Clarke.

Brochure from American Directional Drill, DD–15 / DD–30 Directional Drills.

Brochure from bor–mor, Self–Contained Directional Drilling Equipment, Model 400TX.

*Primary Examiner*—Hoang C. Dang

*Attorney, Agent, or Firm*—Glenn Johnson

[57] ABSTRACT

An underground directional drilling steering tool for use with a variety of commercially known drill bits which controls the direction of drill while the drill bit is directly powered by the drill string by way of a drill string coupling. The offset transmitter housing retains the tool in a stable orientation downhole by means of the drill string coupling offset orientation in the housing and stabilizing fins affixed to the exterior of the offset transmitter housing. The positioning of the drill bit in relation to the positioning of the offset transmitter housing in the center of the borehole creates a drilling pathway with a constant curvature away from the wide side of the offset transmitter housing. The direction of this curvature is controlled by means of a jaw clutch, which jaw clutch is engaged by drawing back slightly on the drill string thereby retracting the drive shaft and pulling the drill bit coupling within closer proximity to the offset transmitter housing. Thereafter, the drill string is carefully rotated to reposition the orientation of the offset transmitter housing from 1° to 359° from its previous position following which forward drilling again proceeds.

25 Claims, 4 Drawing Sheets

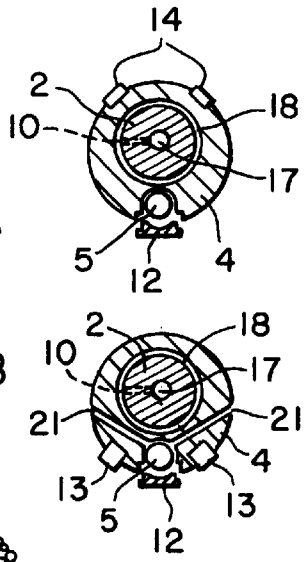
FIG. 2A
FIG. 2B
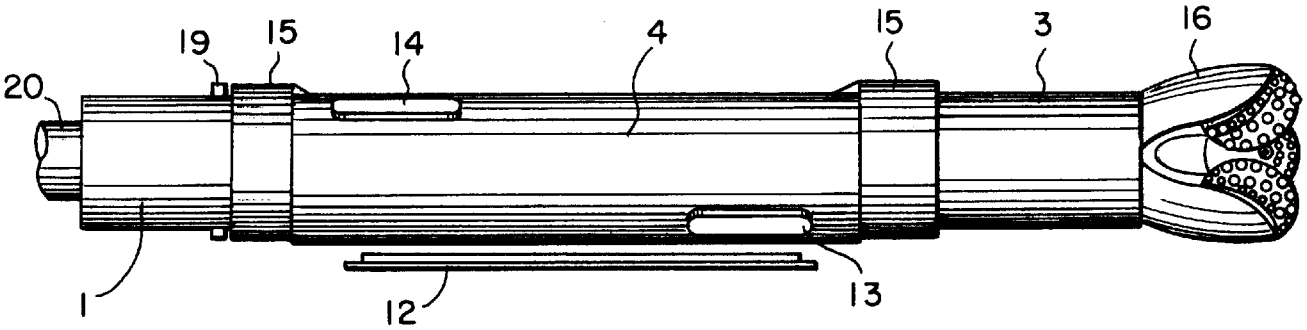
FIG. 1
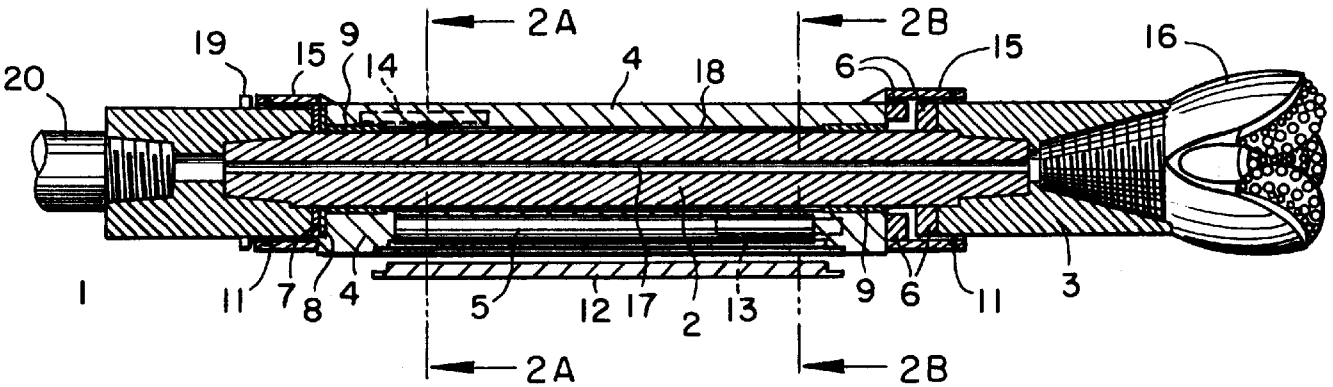
FIG. 2

UNDERGROUND DIRECTIONAL DRILLING STEERING TOOL

BACKGROUND OF THE INVENTION

In the last 15 years, the use of horizontal underground drilling has become increasingly effective, and more widely accepted for the installation of water and gas pipes, underground utilities, telephone lines, and cables. Prior to the use of these horizontal drilling techniques, open trenches were required to primarily place pipes, cables and wires underground. Particular difficulties were encountered in crossing bodies of water, roads, driveways, improved areas, or existing sewer and water installations. Accordingly, directional horizontal drilling techniques have allowed for the elimination of open trenches, particularly when encountering obstacles at or near the surface.

With the development of these horizontal drilling techniques, there has been an historic need to develop a more precise and cost effective system to effectively control the route of travel, depth of travel and point of emergence for the drilling apparatus. In response to these needs, the radio transmitting unit was developed and incorporated into the drilling apparatus to broadcast a remote signal which would aid in identifying the position, direction of travel and pitch of the drilling apparatus. Improvements have been noted in some areas of underground directional drilling, but the ability to efficiently and cost effectively control the direction of the drilling head when in rock or a mixture of rock and dirt has continued to present challenges to those in the industry.

Various attempts have been made to achieve this directional control. These attempts have either proved largely unsuccessful due to the rough and demanding downhole environment to which the drilling apparatus is subjected, or involved an elaborate and expensive mechanism in an effort to change the drilling orientation angle. For example, the Schoeffler U.S. Pat. No. 4,732,223, and the Warren U.S. Pat. No. 5,547,031, and the Eddison U.S. Pat. No. 5,520,256, each describe an elaborate mechanical system to alter the angle of orientation of the drill head. In the '223 patent, a clutch mechanism is employed to lock the exterior housing and to activate a hydraulic deflection mechanism utilizing the drilling fluid so as to elastically deflect the drilling shaft which pivotally alters the angular orientation of the drill head. The '256 patent employs a mud motor and a drill bit coupling mechanism comprised of multiple housings, the lower of which has an upper and drill bit coupling joined together to define a bend angle allowing for the line of drilling to turn, which radius of curvature is enhanced by the extension of a hydraulic piston which results in a shift of opposed pads against the low side of the borehole increasing the bend angle and sharpening the radius of curvature. The '031 patent employs an internal flexible joint comprised of a ball-shaped member seated in a spherical housing combined with a hydraulically actuated blade on the exterior of the housing which can be extended outwardly against the surface of the borehole to cam the housing to one side of the borehole thereby changing the angle of orientation for the drill head due to the resultant movement within the flexible joint.

The Kinnan U.S. Pat. No. 5,449,046, discusses a detailed steerable drilling apparatus for lateral underground drilling. This is the primary area of use anticipated with the present invention. The '046 patent employs a series of hydraulically driven pistons which are actuated outwardly against the side of the borehole to deflect the drill head housing in an opposing direction thereby altering the angle of the drilling.

Another example of an elaborate internal mechanism utilized to steer the drilling head is found in the Eddison U.S. Pat. No. 5,529,133. Similar to the '256 and '031 patent, this apparatus utilizes a circumferential coupling system that allows the drill head to be affixed at an angle differing from the axis of the drilling shaft.

The Brotherton U.S. Pat. No. 5,490,569 is similar to the '223 patent in that it incorporates a flexible shaft mounted within the housing in such a manner that when the shaft is elastically deflected, it alters the angle of orientation of the drill head in relation to the axis of the drill housing. It utilizes an outer sleeve to prevent the housing from turning down hole when the shaft is actuated turning the bit. This external sleeve extends the entire length of the drill string and is also utilized to change the orientation of the housing thereby changing the angle of orientation of the drill head so as to drill in a differing direction.

A final problem not adequately addressed by the various apparatus involves the functionality of the steering mechanism and the speed of the progress when drilling through less than ideal soil conditions. The currently available devices proceed through rocky conditions at a labored rate resulting in additional expenses to the contractor.

SUMMARY OF THE INVENTION

The present invention addresses the need to provide a durable, less complex, lower maintenance, lower cost directional steering tool which affords the operator the ability to directionally control the depth and pathway of the borehole being drilled. The present invention is particularly effective in drilling through rock, rock laden soil and dense soil when fitted with any one of a variety of rock bits. The drilling apparatus is best suited for the high torque power delivered directly from the drill string 20. In powering the drilling apparatus directly from the drill string 20, full torque of the drilling unit may be delivered to the drill bit 16 along with a great amount of forward thrust which allows the drilling apparatus to cut through rock and rock laden soils with relative ease and speed compared to most of the other directional drilling apparatus available. Another benefit associated with powering the drilling apparatus directly from the drill string is that longer bores are generally possible compared to underground drilling apparatus that function without the drill string rotating during the operation.

Unlike other directional drilling apparatus, the invention provides a steerable mechanism comprised of an inflexible drive shaft 2 passing through the offset transmitter housing 4 and stabilizer fins 13 employing frictional resistance to prevent the offset transmitter housing 4 from rotating downhole when the bit is being powered. A single or plurality of stabilizer fins 13 may be utilized. The stabilizing fins 13 vary in height and width, and may be flat sided or tapered. Stabilizing fins 13 are located on the side wall furthest from the drive shaft 2 near the front of the offset transmitter housing 4, and may also be located on the opposing side wall of the offset transmitter housing 4 near the rear. The stabilizing fins 13 operate to center the offset transmitter housing 4 in the borehole and providing a ready pathway for the flow of drilling fluid and cutting debris past the drilling apparatus. Additionally, the cutting debris and the drilling fluid flowing past the stabilizing fins 13 operate to provide a medium with additional frictional resistance to maintain the offset transmitter housing 4 in a stable position and prevent its rotation within the borehole even when drilling through solid rock.

Also, unlike some other directional drilling apparatus, there is no need to have a sleeve or some other mechanism extending to the surface to stabilize the drilling apparatus or alter the drilling orientation. The steering mechanism of the current invention utilizes a jaw clutch 6 located between two of its sections which is disengaged in forward drilling operation. The jaw clutch 6 is engaged when the drill string 20 is slightly retracted which operates to lock the first half of the jaw clutch 6 located at the front end of the offset transmitter housing 4 into the second half of the jaw clutch 6 located at the rear of the drill bit coupling 3. Each face of the corresponding jaw clutch 6 half may be beveled to facilitate engagement and allow for the ready removal of cuttings and debris from the engaging surfaces. Once the jaw clutch 6 is engaged, the operator with a controlled rotation of the drill string 20 may carefully rotate the offset transmitter housing 4 within the borehole from 1° to 360° so as to alter the orientation of the drilling pathway as required. The offset location of the drill bit in relation to the offset transmitter housing 4 centered within the borehole results in a constant curvature of the drill path away from the wide side of the offset transmitter housing 4, thus providing a constant arc to the pathway of the borehole as drilling progresses forward. In order to maintain an approximate straight path of bore during the drilling operation, the operator alternates back and forth the orientation of the offset transmitter housing 4 by approximately 180° so as to correct for the constant curvature.

As a result of the elimination of sophisticated or cumbersome mechanical means to redirect the pathway of the drilling operation, and allowing for downhole adjustment, the drilling operators are offered a quick and efficient means to control the direction of their drilling and accomplish the required task with a minimum of effort and expense. Further, by the elimination of the sophisticated mechanisms, the current invention presents the operator with a more cost effective alternative to other equipment necessary to directionally control the underground drilling operation.

BRIEF DESCRIPTION OF THE DRAWING

FIG. 1 is a side perspective view of the underground directional drilling steering tool showing the drill string 20, drill string coupling 1, offset transmitter housing 4, drill bit coupling 3 and the drill bit 16 affixed to the drill bit coupling 3.

FIG. 2 is another perspective view of the underground directional drilling steering tool showing a segmented view of the interior of the offset transmitter housing 4 at the two indicated locales.

FIG. 2A is a cross-sectional drawing of the offset transmitter housing near its rear end.

FIG. 2B is a cross-sectional drawing of the offset transmitter housing near its front end.

DESCRIPTION OF THE PREFERRED EMBODIMENT OF THE INVENTION

Figure 3:
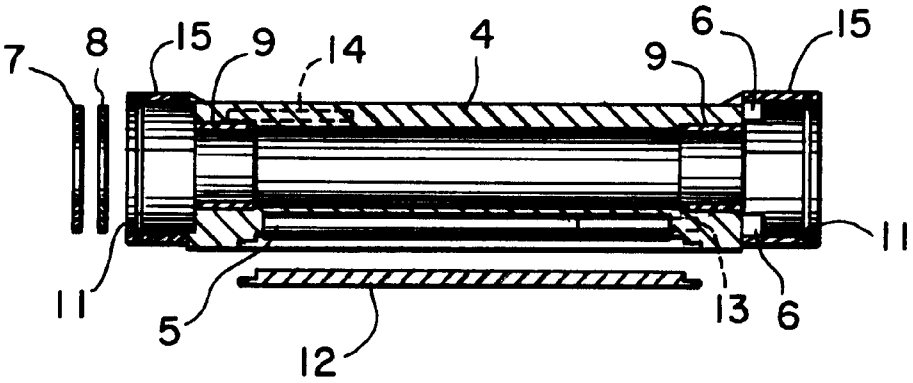
FIG. 3 is a open perspective view of the offset transmitter housing 4 exposing the drive shaft cavity 18 absent the drive shaft 2.
Figure 4:
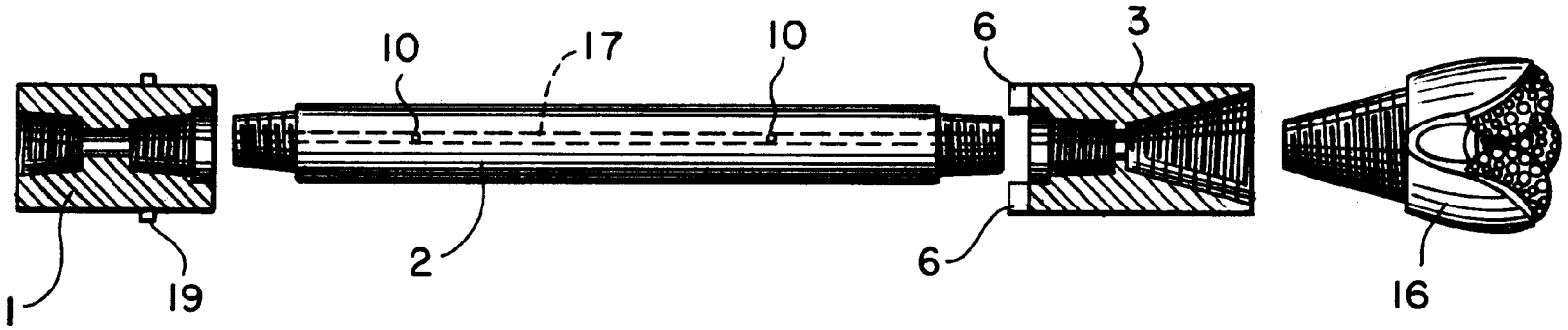
FIG. 4 is a perspective view of the drive shaft 2 in relation to the open perspective views of the drill string coupling 1 and drill bit coupling 3.
Figure 5:
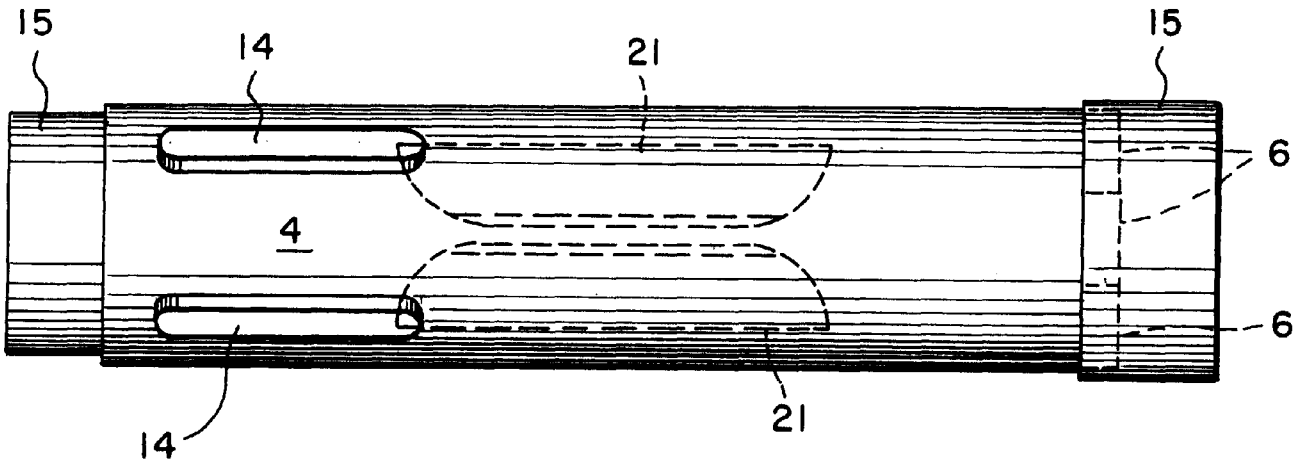
FIG. 5 is a perspective view showing the upper side of the offset transmitter housing 4.
Figure 6:
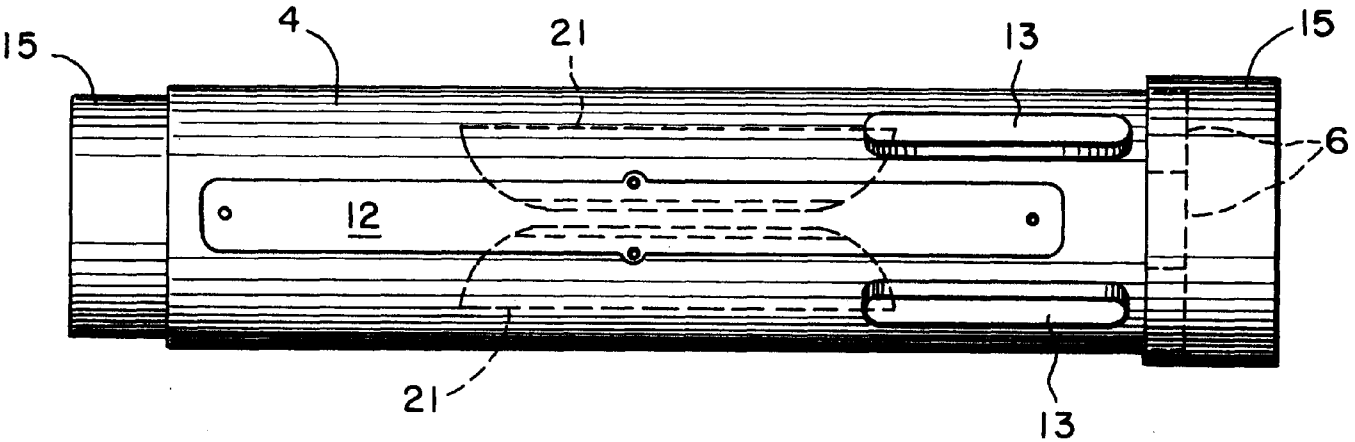
FIG. 6 is a perspective view showing the lower side of the offset transmitter housing 4.
Figure 7A:
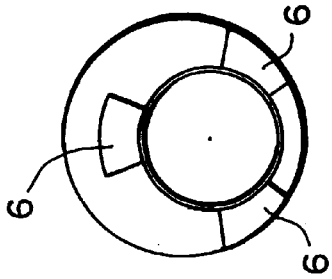
FIG. 7A is the end view of FIG. 7 showing the first half of the jaw clutch.
Figure 9:
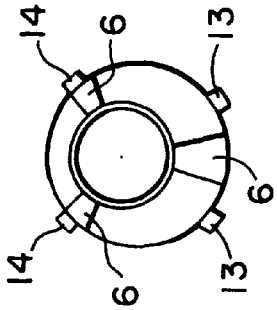
FIG. 9 is a front view of the offset transmitter housing 4 showing the stabilizing fins 13 at the forward portion of its upper side and the stabilizing fins 13 at the rearward portion of its lower side.
Figure 7:
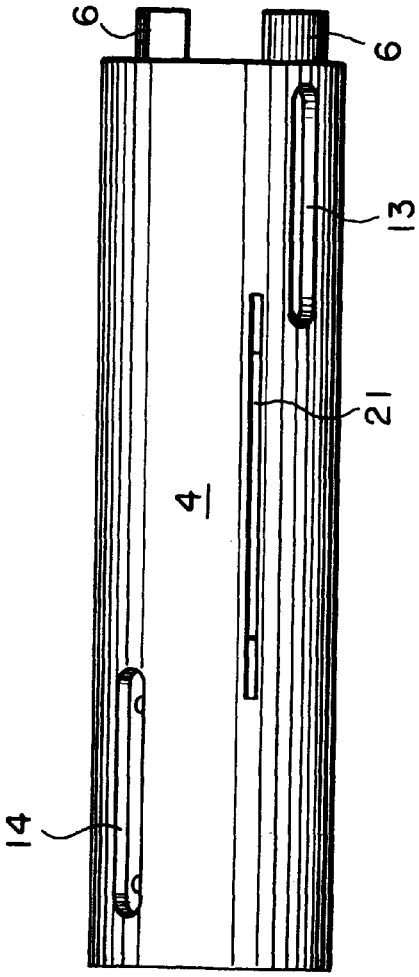
FIG. 7 is a perspective view and a front view of the offset transmitter housing 4 showing the first half of the jaw clutch 6.
Figure 8:
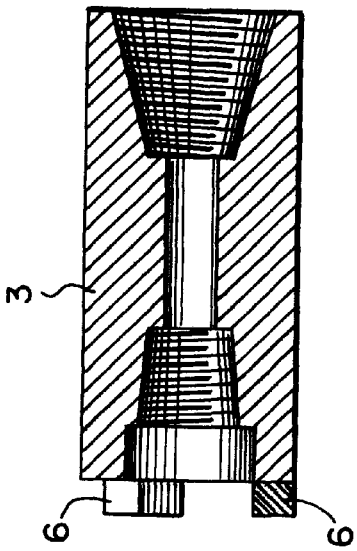
FIG. 8 is an open perspective view and a rear view of the drill bit coupling 3 showing the second half of the jaw clutch 6.
Figure 8A:
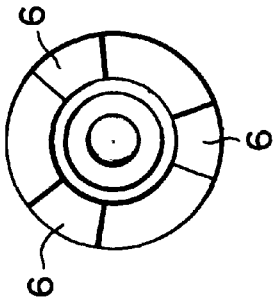
FIG. 8A is the end view of FIG. 8 showing the second half of the jaw clutch.

In its preferred embodiment, and referring to FIG. 1, the present invention, an underground directional drilling steering tool, is comprised of three sections. The drill string coupling 1 is threaded on its upper end for easy coupling to the drill string 20, and is securely affixed to the upper end of the drive shaft 2 running through the offset transmitter housing 4 of the steering tool. The drill bit coupling 3 at its upper end is securely affixed to the lower end of the drive shaft 2 passing through the offset transmitter housing 4, and at its lower end is threaded to allow for easy attachment of various drill bits 16.

The offset transmitter housing 4 provides a variety of functions to the steering tool. First, it houses the transmitter 5 which sends information to the operator pertaining to the direction, depth, orientation and angle of the steering tool as the drilling operations downhole progress. Secondly, affixed to the exterior of the offset transmitter housing 4 are the stabilizing fins 13 which function to provide frictional surface areas to prevent the rotation of the offset transmitter housing 4 and to hold the offset transmitter housing 4 in a stable orientation within the borehole. Thirdly, the drive shaft 2 passes through the elongated drive shaft cavity 18 within the offset transmitter housing 4 which is positioned off of the center line of the offset transmitter housing 4, and is allowed to rotate and to slide freely within the offset transmitter housing 4. Sets of bearings 9 are located within the offset transmitter housing 4 to hold and facilitate the free movement of the drive shaft 2. The hollow interior of the drive shaft 2 creates the drilling fluid passageway 17 which carries the pressurized drilling fluid, and small fluid holes 10 placed in the drive shaft 2 extending to the drilling fluid passageway 17 allow for the escape of some of the drilling fluid into the drive shaft cavity 18 which functions to cool, lubricate, and flush the bearings, and to provide a continuous washing action removing cuttings from the area of the drive shaft 2, clutch 6 and bearings 9. Although circular in nature, the wide side of the offset transmitter housing 4 retains a cover plate 12 closing off the cavity in which the transmitter 5 is housed, and the narrow side of the offset transmitter housing 4 is the side nearest to the drive shaft 2 passing through it. Transmitter windows 21 are cut into the offset transmitter housing 4 and sealed with nonmetallic material to allow the transmitter signal to reach the operator.

Front stabilizer fins 13 are located on the side wall furthest from the drive shaft 2 near the front of the offset transmitter housing 4, and rear stabilizing fins 14 are also located on the opposing side wall of the offset transmitter housing 4 near the rear. The stabilizing fins 13 operate to center the offset transmitter housing 4 in the borehole and provide a ready pathway for the flow of drilling fluid and cutting debris past the drilling apparatus. The cutting debris and the drilling fluid flowing past the stabilizing fins 13 operate to provide a medium with additional frictional resistance to maintain the offset transmitter housing 4 in a stable position even when drilling through solid rock. Use of the rear stabilizing fins 14 is preferred to assist in centering the offset transmitter housing 4 within the borehole, and maintaining the offset transmitter housing 4 in a stable position.

The most stable operation of the directional drilling apparatus arises with the use of two (2) front stabilizing fins 13 and two (2) rear stabilizing fins 14. Each pair of stabilizing fins are located at angles apart of approximately 85°±15°, and the front stabilizing fins 13 are located on the front of the offset transmitter housing 4 opposingly to the rear stabilizing fins 14 located on the rear of the offset transmitter housing 4. The height of the stabilizing fins varies from ¼ inch upwardly depending on the size of the borehole. The configuration of the stabilizing fins are elongated rectangles. Stabilizing fins tapering to a point were found to wear excessively in the demanding downhole environment Further, the flat outer surface of the stabilizing fins provides additional frictional surface area to aid in retaining the offset transmitter housing 4, particularly while drilling through dense soils or rock.

The upper end of the offset transmitter housing 4 contains an circular opening which accepts the reduced lower end of the drill string coupling 1 as forward thrust is being applied during the drilling operation. A thrust bearing 7 is located at the base of the circular opening to facilitate the forward push of the offset transmitter housing 4 as drilling progresses.

A wear plate 8 is located behind the thrust bearing 7 which facilitates longer wear of the thrust bearing 7. A spoil shield 19 is located around the drill string coupling 1 to prevent dirt and rock pieces, generally referred to as spoil, from entering the area between the drill string coupling 1 and the offset transmitter housing 4. Each transmitter housing 4 is extended to form spoil covers 15 in which are positioned seals 11 to further prevent spoil from accessing the area between the offset transmitter housing 4 and the drill string coupling 1 or the area between the offset transmitter housing 4 and the drill bit coupling 3.

The offset nature of the drive shaft 2 passing through the offset transmitter housing 4 operates to position the drill bit 16 above the centerline of the offset transmitter housing 4. As long as the offset transmitter housing 4 remains stationary downhole, the drill bit 16 will cut a pathway with a constant curvature away from the wide side of the offset transmitter housing 4. The orientation of the steering tool is accomplished by use of jaw clutch 6 at the connection between the offset transmitter housing 4 and the drill bit coupling 3. The jaw clutch 6 utilizes a plurality of teeth and notches. When forward thrust is being applied during the drilling operation, the jaw clutch 6 is disengaged by the drive shaft 2 sliding forward through the offset transmitter housing 4 until the lower end of the drill string coupling 1 comes into contact with the thrust bearing 7 located within the cavity at the upper end of the offset transmitter housing 4. This allows the drill bit coupling 3 and the attached drill bit 16 to spin freely without the transfer of rotational force to the offset transmitter housing 4. Forward thrust against thrust bearing 7 pushes the offset transmitter housing 4 ahead as the drilling operation progresses.

In order to steer or alter the course of the drill head, the operator merely pulls back on the drill string 20 a short distance so as to engage the jaw clutch 6. Each face of the corresponding half of the jaw clutch 6 is beveled to facilitate engagement and allow for the ready removal of cuttings and debris from the engaging surfaces. After engagement of the first half and second half of the jaw clutch 6, the operator rotates the drill string 20 the desired degrees so as to reposition the offset transmitter housing 4 within the hole. In this fashion the operator may turn the direction of drilling in any direction without the need of an external steering sleeve or complex mechanism to cam the drill head. This affords the operator the ability to make quick and precise alterations in the direction of the drilling pathway.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

We claim:

1. A drilling apparatus having a directional control for boring or cutting a hole beneath the surface of the ground, said apparatus comprising:

a drive shaft rotatable about a central axis;

an offset transmitter housing having an elongated drive shaft cavity through which the drive shaft passes, and further having a front end, a rear end, a first side and a second side, the first side being positioned closer to central axis of the drive shaft than the second side;

a thrust bearing positioned at the rear of the offset transmitter housing;

the drive shaft having a front connection point extending from the front end of the offset transmitter housing and a rear connection point extending from the rear end of the offset transmitter housing;

a drill string coupling having a rear connection point and a front connection point with the front connection point operatively connected to the rear connection point of the drive shaft;

a drill bit coupling having a rear connector and a forward connector with the rear connector operatively connected to the front connection point of the drive shaft;

a drill bit operatively connected to the forward connector of the drill bit coupling for creating a borehole;

power means for rotating the drive shaft operatively connected to the rear connection point of the drill string coupling;

transmitting means combined with the offset transmitter housing for sending information to the surface of the ground pertaining to the position, direction, orientation and pitch of the offset transmitter housing;

means for controllably changing the orientation of the first and second side of the offset transmitter housing while the apparatus is within the borehole;

means for retaining the offset transmitter housing in a selected position of orientation within the borehole comprised of at least a stationary stabilizing fin which is combined with the offset transmitter housing; and means for conveying drilling fluid from the surface of the ground to the drill bit.

2. The apparatus of claim 1 wherein at least a stationary stabilizing fin is combined with the transmitter housing near its front end on the bottom side of said housing.

3. The apparatus of claim 1 wherein at least a stationary stabilizing fin is combined with the transmitter housing near its rear end on the top side of said housing.

4. The apparatus of claim 1 wherein at least a stationary stabilizing fin is combined with the transmitter housing near its front end on the bottom side of said housing and at least a stationary stabilizing fin is combined with the transmitter housing near its rear end on the top side of said housing.

5. The apparatus of claim 1 wherein the offset transmitter housing comprises a housing for a radio transmitter utilized to transmit information to the surface regarding the position, direction, orientation and pitch of the drilling apparatus.

6. The apparatus of claim 1 wherein the offset transmitter housing comprises a housing holding a sending unit providing information regarding the position, direction, orientation and pitch of the drilling apparatus to the operator over wires extending to the surface.

7. The apparatus of claim 1 wherein a drill string having a surface end and a front end with the surface end affixed to the power means and the front end affixed to the rear connection point of the drill string coupling.

8. The apparatus of claim 8 wherein the drive shaft is solid and inflexible.

9. The apparatus of claim 1 wherein the drive shaft contains a drilling fluid passageway.

10. The apparatus of claim 9 wherein the drive shaft is sufficiently stiff so as to prevent bowing or flexion of the shaft as the drilling apparatus is mechanically pushed forward in the drilling operation.

11. A drilling apparatus having a directional control for boring or cutting a hole beneath the surface of the ground, said apparatus comprising:

a drive shaft rotatable about a central axis;

an offset transmitter housing having an elongated drive shaft cavity through which the drive shaft passes, and further having a front end, a rear end, a first side and a second side, the first side being positioned closer to central axis of the drive shaft than the second side;

a thrust bearing positioned at the rear of the offset transmitter housing;

the drive shaft having a front connection point extending from the front end of the offset transmitter housing and a rear connection point extending from the rear end of the offset transmitter housing;

a drill string coupling having a rear connection point and a front connection point with the front connection point operatively connected to the rear connection point of the drive shaft;

a drill bit coupling having a rear connector and a forward connector with the rear connector operatively connected to the front connection point of the drive shaft;

a drill bit operatively connected to the forward connector of the drill bit coupling for creating a borehole;

power means for rotating the drive shaft operatively connected to the rear connection point of the drill string coupling;

transmitting means combined with the offset transmitter housing for sending information to the surface of the ground pertaining to the position, direction, orientation and pitch of the offset transmitter housing;

means for controllably changing the orientation of the first and second side of the offset transmitter housing while the apparatus is within the borehole comprising a jaw clutch having a rear half of the jaw clutch located at the front end of the offset transmitter housing and a front half of the jaw clutch at the rear end of the drill bit coupling;

means for retaining the offset transmitter housing in a selected position of orientation within the borehole comprising a stabilizing fin combined with the offset transmitter housing; and means for conveying drilling fluid from the surface of the ground to the drill bit.

12. The apparatus of claim 11 wherein the offset transmitter housing comprises a housing for a radio transmitter utilized to transmit information to the surface regarding the position, direction, orientation and pitch of the drilling apparatus.

13. The apparatus of claim 11 wherein the offset transmitter housing comprises a housing holding a sending unit providing information regarding the position, direction, orientation and pitch of the drilling apparatus to the operator over wires extending to the surface.

14. The apparatus of claim 11 wherein a drill string having a surface end and a front end with the surface end affixed to a power source and the front end is affixed to the rear connection point of the drill string coupling which operates to rotatably power the drill bit.

15. The apparatus of claim 11 wherein the drive shaft is solid and inflexible.

16. The apparatus of claim 11 wherein the drive shaft contains a drilling fluid passageway.

17. The apparatus of claim 16 wherein the drive shaft is sufficiently stiff so as to prevent bowing or flexion of the shaft as the drilling apparatus is mechanically pushed forward in the drilling operation.

18. A drilling apparatus having a directional control for boring or cutting a hole beneath the surface of the ground which creates drilling debris, said apparatus comprising:

a drive shaft rotatable about a central axis having a drilling fluid passageway;

an offset transmitter housing having an elongated drive shaft cavity through which the drive shaft passes, and further having a front end, a rear end, a first side and a second side, the first side being positioned closer to the central axis of the drive shaft than the second side;

a thrust bearing positioned at the rear of the offset transmitter housing;

the drive shaft having a front connection point extending from the front end of the offset transmitter housing and a rear connection point extending from the rear end of the offset transmitter housing;

a drill string coupling having a rear connection point and a front connection point with the front connection point operatively connected to the rear connection point of the drive shaft;

a drill bit coupling having a rear connector and a forward connector with the rear connector operatively connected to the front connection point of the drive shaft;

a drill bit operatively connected to the forward connector of the drill bit coupling for creating a borehole;

power means for rotating the drive shaft operatively connected to the rear connection point of the drill string coupling;

transmitting means combined with the offset transmitter housing for sending information to the surface of the ground pertaining to the position, direction, orientation and pitch of the offset transmitter housing;

means for controllably changing the orientation of the first and second side of the offset transmitter housing while the apparatus is within the borehole comprising a jaw clutch having a rear half of the jaw clutch located at the front end of the offset transmitter housing and a front half of the jaw clutch at the rear end of the drill bit coupling;

means for retaining the offset transmitter housing in a selected position of orientation within the borehole comprised of at least a stabilizing fin combined with the offset transmitter housing;

means for conveying drilling fluid from the surface of the ground to the drill bit; and means for lubricating the drive shaft and preventing drilling debris from entering or lodging within the drive shaft cavity within the offset transmitter housing.

19. The apparatus of claim 18 having at least one fluid hole accessing the drilling fluid passageway allowing drilling fluid to flow into the drive shaft cavity.

20. The apparatus of claim 18 wherein the drive shaft cavity is sealed and filled with oil or other lubricating material.

21. The apparatus of claim 18 wherein the offset transmitter housing comprises a housing for a radio transmitter utilized to transmit information to the surface regarding the position, direction, orientation and pitch of the drilling apparatus.

22. The apparatus of claim 18 wherein the offset transmitter housing comprises a housing holding a sending unit providing information regarding the position, direction, orientation and pitch of the drilling apparatus to the operator over wires extending to the surface.

23. The apparatus of claim 18 wherein a drill string having a surface end and a front end with the surface end affixed to a power source and the front end is affixed to the rear connection point of the drill string coupling which operates to rotatably power the drill bit.

24. The apparatus of claim 23 wherein the drive shaft is sufficiently stiff so as to prevent bowing or flexion of the shaft as the drilling apparatus is mechanically pushed forward in the drilling operation.

25. A drilling apparatus having a directional control for boring or cutting a hole beneath the surface of the ground, said apparatus comprising:

a drive shaft rotatable about a central axis;

an offset transmitter housing having an elongated drive shaft cavity through which the drive shaft passes, and further having a front end, a rear end, a first side and a second side, the first side being positioned closer to central axis of the drive shaft than the second side;

a thrust bearing positioned at the rear of the offset transmitter housing;

the drive shaft having a front connection point extending from the front end of the offset transmitter housing and a rear connection point extending from the rear end of the offset transmitter housing;

a drill string coupling having a rear connection point and a front connection point with the front connection point operatively connected to the rear connection point of the drive shaft;

a drill bit coupling having a rear connector and a forward connector with the rear connector operatively connected to the front connection point of the drive shaft;

a drill bit operatively connected to the forward connector of the drill bit coupling for creating a borehole;

power means for rotating the drive shaft operatively connected to the rear connection point of the drill string coupling;

transmitting means combined with the offset transmitter housing for sending information to the surface of the ground pertaining to the position, direction, orientation and pitch of the offset transmitter housing;

means for controllably changing the orientation of the first and second side of the offset transmitter housing while the apparatus is within the borehole;

means for retaining the offset transmitter housing in a selected position of orientation within the borehole comprised of at least a stabilizing fin affixed to the exterior of the transmitter housing near its front end on the bottom side of said housing and at least a stabilizing fin affixed to the exterior of the transmitter housing near its rear end on the top side of said housing; and means for conveying drilling fluid from the surface of the ground to the drill bit.

* * * * *